US007445545B2

(12) United States Patent
Abe et al.

(10) Patent No.: US 7,445,545 B2
(45) **Date of Patent: *Nov. 4, 2008**

(54) COIN DISPENSING APPARATUS

(75) Inventors: Hiroshi Abe, Iwatsuki (JP); Yasuo Irie, Iwatsuki (JP)

(73) Assignee: Asahi Seiko Kabushiki Kaisha, Saitama-ken (JP)

( * ) Notice: Subject to any disclaimer, the term of this patent is extended or adjusted under 35 U.S.C. 154(b) by 501 days.

This patent is subject to a terminal disclaimer.

(21) Appl. No.: 11/006,191

(22) Filed: Dec. 7, 2004

(65) Prior Publication Data

US 2005/0176360 A1 Aug. 11, 2005

(30) Foreign Application Priority Data

Jan. 26, 2004 (JP) ..... 2004-017702

(51) Int. Cl.
*G07D 1/00* (2006.01)

(52) U.S. Cl. ..... 453/57

(58) Field of Classification Search ..... 453/57, 453/49, 33–35, 63

See application file for complete search history.

(56) References Cited

U.S. PATENT DOCUMENTS 3,094,918 A * 6/1963 Mueller et al. ..... 99/289 R
3,830,484 A * 8/1974 Bright et al. ..... 269/10
6,099,402 A * 8/2000 Abe et al. ..... 453/57
7,013,938 B2 * 3/2006 Liu ..... 144/117.1

FOREIGN PATENT DOCUMENTS

JP 2004-065572 3/2004

* cited by examiner

*Primary Examiner*—Patrick Mackey
*Assistant Examiner*—Mark Beauchaine
(74) *Attorney, Agent, or Firm*—McGlew & Tuttle, P.C.

(57) ABSTRACT

A coin dispensing apparatus is provided that has features to easily adjust the distance between the base plate and the rotating disk and to adapt to the thickness of the coins. The coin dispensing apparatus includes a disk (102) which separates coins one by one. A coin base (104) supports the coins which are moved by the disk. A body (100) includes the base and a step section (149) which provides different distances to the base to adapt to the thickness of the coins. A rotating shaft member (160) is selectively attached to the step section and can be adjusted to the body. The rotating shaft member for rotating the disk is selectively attached at the step section in stages. Therefore the distance between the disk and the base is adjusted to adapt the thickness of coin.

20 Claims, 8 Drawing Sheets

COIN DISPENSING APPARATUS

CROSS REFERENCE TO RELATED APPLICATIONS

This application claims the benefit of priority under 35 U.S.C. § 119 of Japan Application No. 2004-017702 filed Jan. 26, 2004, the entire contents of which are incorporated herein by reference.

FIELD OF THE INVENTION

This invention relates to a coin dispensing apparatus with which many coins (coins, tokens, medals, discs, etc.), are dispensed one by one.

BACKGROUND OF THE INVENTION

Some coin dispensing apparatuses are known In prior art. For example, Japanese Laid Open Patent Number 11-96426 and 11-86066 which were in the name of the assignee of the present application.

In Japanese Laid Open Patent 11-96426, the coin dispensing apparatus is adaptable to the coin thickness. The apparatus includes a base plate on which the coin slides, a disk which dispenses the coins one by one, a rotating shaft which rotates the disk, a lifter where the rotating shaft penetrates rotatably and can move towards and away from the base plate, an operating body which adjusts the disk position to the base plate and a stopper which is attached to rotating out of the shaft which prevents the rotating shaft to move.

In the prior art, when a thinner coin is used, the operating body is not operated, instead of it, a saw tooth is moved. Therefore the saw tooth has engaged with the operating body. In other words, the lifter doesn't protrude from the base plate. The distance between the base plate and the disk is small. Therefore the distance is adapted to the thinnest coin. Inversely, when the thickness is at the thickest extent, the operating body is operated. Therefore the handle of operating body is pivoted, then it is fixed at a predetermined position. As a result, the lifter protrudes from the base plate.

Therefore the distance between the base plate and the rotating disk increases, and it adapts to the thickness of the coin. In other words, the slanting surface of the saw tooth of the lifter which is stopped in the rotation is moved by the slanting surface of the saw tooth of the operating body. As a result, the lifter protrudes from the base plate.

On the other hand, the apparatus which is disclosed on Japanese Laid Open Patent 11-86066 is a smaller coin dispensing apparatus and includes a rotating disk for dispensing the coins one by one, a rotating shaft for rotating the rotating disk, a planetary gear train where the center axis is located on the center axis of the rotating shaft, a rotating shaft of a motor where the center axis is located on the center axis of the planetary gear train. Also, it includes a spacer for adjusting the position of the disk to the thickness of the coin.

In the apparatus, for adjusting the thickness of the coin, a spacer is added around the rotating shaft, and the gear section of the rotating shaft is inserted into the penetrating hole of the base plate. The gear section is inserted into the cylinder section of a carrying plate of the planetary gear train. When the thickness of the coin is thin, the spacer is removed, and the gear section of the rotating shaft is inserted into the cylinder section which passes through the penetrating hole of the base plate.

Therefore this apparatus can be adapted to the thickness of the coin by the spacer in as the same as the Japanese Laid Open Patent 11-96426 which adjusts the distance between the base plate and the rotating disk.

Also, the known apparatus include a stopper which has contact with the conical section of the rotating shaft and which prevents the removing of the rotating shaft.

In Japanese Laid Open Patent 11-86066 (FIGS. 3 and 4, paragraphs 10 and 11), when the distance is adjusted to the thickness of the coin, the spacer is changed to another spacer. Therefore the changing of the spacer is troublesome.

In Japanese Laid Open Patent 11-96426 (FIGS. 2, 3 and 4, paragraphs 15 and 16), the operating body and the stopper are removed from the positions. The operation is too troublesome. Also, the stopper has contact with the conical section and prevents the removing of the rotating shaft. In other words, the conical section includes a predetermined angle for preventing the removal of the rotating shaft. The rotating shaft needs a predetermined strength. In other words, the rotating shaft needs a predetermined diameter. Therefore the length of the conical section is limited. In other words, the adjusting range of the rotating disk is limited by the diameter of the rotating shaft and the angle of the conical section.

SUMMARY OF THE INVENTION

The first object of the invention is to provide a coin dispensing apparatus in which it is easy to adjust the distance between the base plate and the rotating disk and to adapt it to the thickness of the coins.

The second object of the invention is to provide a coin dispensing apparatus which is not limited by the adjusting range.

The third object of the invention is to provide a coin dispensing apparatus which can adjust the position in stages while seeing the disk.

For solution of this problem, this present invention is structured as follows. A coin dispensing apparatus comprises a disk which separates coins one by one, a base which holds the coins which are moved by the disk, a body which includes the base and a step section which has the different distance to the base to adapt to the thickness of the coins. A rotating shaft member is selectively attached to the step section and can be adjusted to the body.

The step section includes plural steps which are located around an inserting hole where the rotating shaft member is inserted into the hole. With this invention, the distance between the disk and the coin base is adjusted in stages to adapt to the thickness of the coin by the step section which is made up by plural portions.

According to an embodiment of the invention, the step section is made as a spiral stair case. With this, the rotating shaft member is attached at a predetermined step section only rotating the rotating shaft member.

The rotating shaft member includes a rotating section for rotating the disk. A pedestal section holds the rotating section rotatably. A cross bar member is detachable relative to the rotating section and functions as a transmitting member attached to the pedestal section. The rotating section of the rotating shaft member is attached at the pedestal section, and is rotatably driven by the cross bar member. Therefore the disk keeps the distance to adapt to the thickness of the coin.

The transmitting member is a disk rotating gear for rotating of the disk from the transmitting gears. The disk rotating gear is attached to the rotating shaft member in the same axis, and includes an inserting hole which is rotatable around the axis, and the inserting hole includes a longitudinal groove where the cross bar member can be moved up and down along the axis. The cross bar member can move up and down in the longitudinal groove of the inserting hole of the transmitting gears. The disk is rotated by the rotating shaft member. The rotating shaft member can move up and down in the transmitting gears. Therefore the disk is adjusted to adapt to the thickness of the coin.

In this structure which is claimed in claim 1, the distance between the coin base and the disk can be adjusted by the rotating shaft member. In other words, the intervening member is not used. Therefore the parts of this invention is reduced as compared to the prior art devices. Also, the distance between the coin base and the disk can be adjusted easily to adapt to the thickness of the coin, because the rotating shaft member is selectively attached at the step section.

The distance between the disk and the coin base can be adjusted in stages to adapt to the thickness of the coin while seeing the step section. The adjusting is with plural steps. Therefore the range of adjustment of the disk is not limited as it is with the prior art devices.

The attaching step for the rotating shaft member can be selected simply by rotation. Therefore the distance between the coin base and the disk can be adjusted easily.

The rotating shaft member is attached firmly. Therefore the distance between coin base and the disk is not increased. As a result, the coins are dispensed in a stable manner every time. Also the rotating shaft member is easily assembled into the device, because the cross bar member can be detached.

The rotating shaft member is moved up and down by the disk rotating gears, and the rotating section is rotated, however the disk rotating gears are not moved. Therefore the height of the apparatus is lower and the apparatus is compact overall.

According to the invention, the coin dispensing apparatus comprises a disk which separates coins one by one, a coin base which holds the coins which are moved by the disk, and a body that includes the base and a step section which differs from the distance to the base to adapt to the thickness of the coins. A rotating shaft member is selectively attached to the step section and can be adjusted to the body. The rotating shaft member for rotating the disk is selectively attached at the step section in stages. Therefore the distance between the disk and the base is adjusted to adapt to the thickness of the coin.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
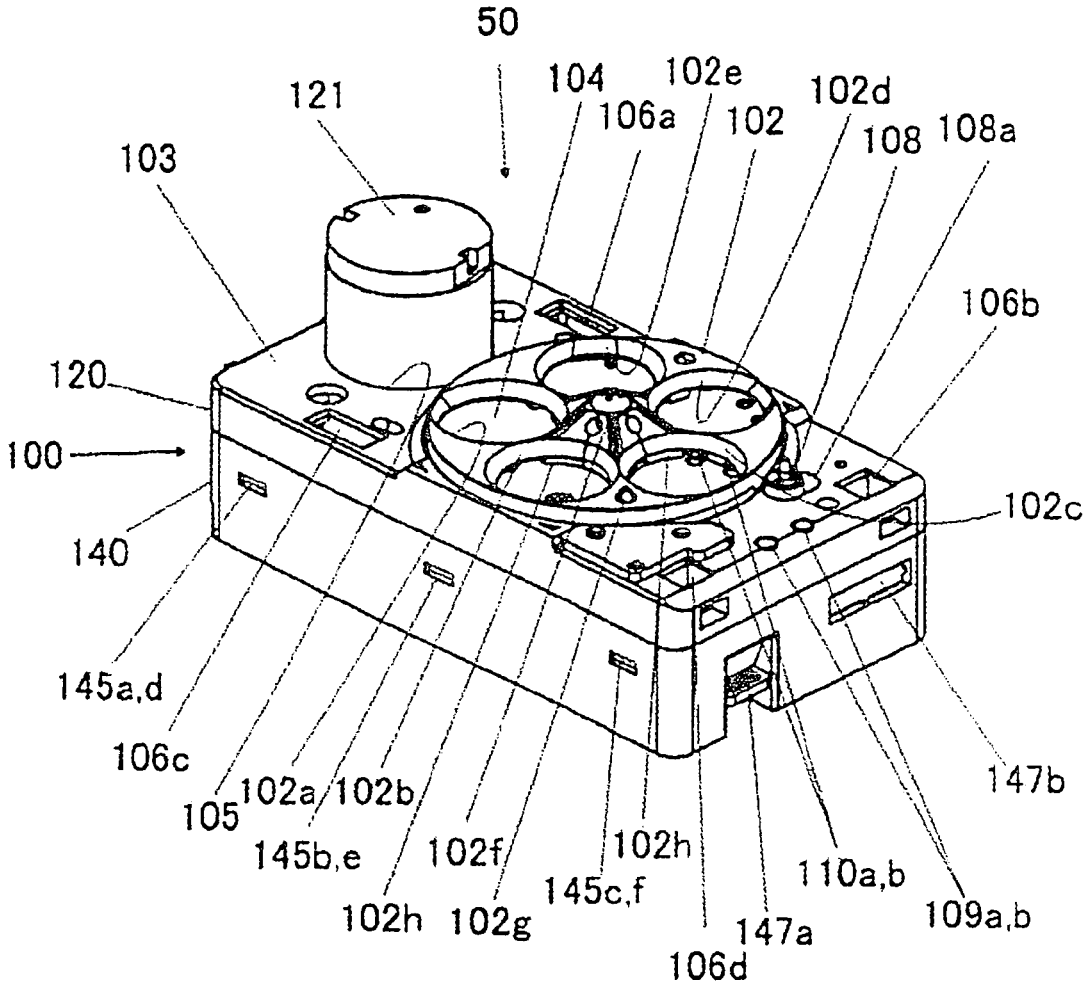
FIG. 1 is a perspective view of the coin dispensing apparatus of an embodiment according to the invention, shown without the hopper.

As shown in FIGS. 1-4, coin dispensing apparatus 50 includes a disk 102 which is located below a hopper 101 and dispenses coins one by one. A base section 120 with base 104 guides the coins which are moved by the disk 102. A driving source section 140 with step section 149 is adjustable to adapt the apparatus for the position to suit the coin thickness. A rotating shaft member 160 is provided for rotating the disk 102.

Figure 3:
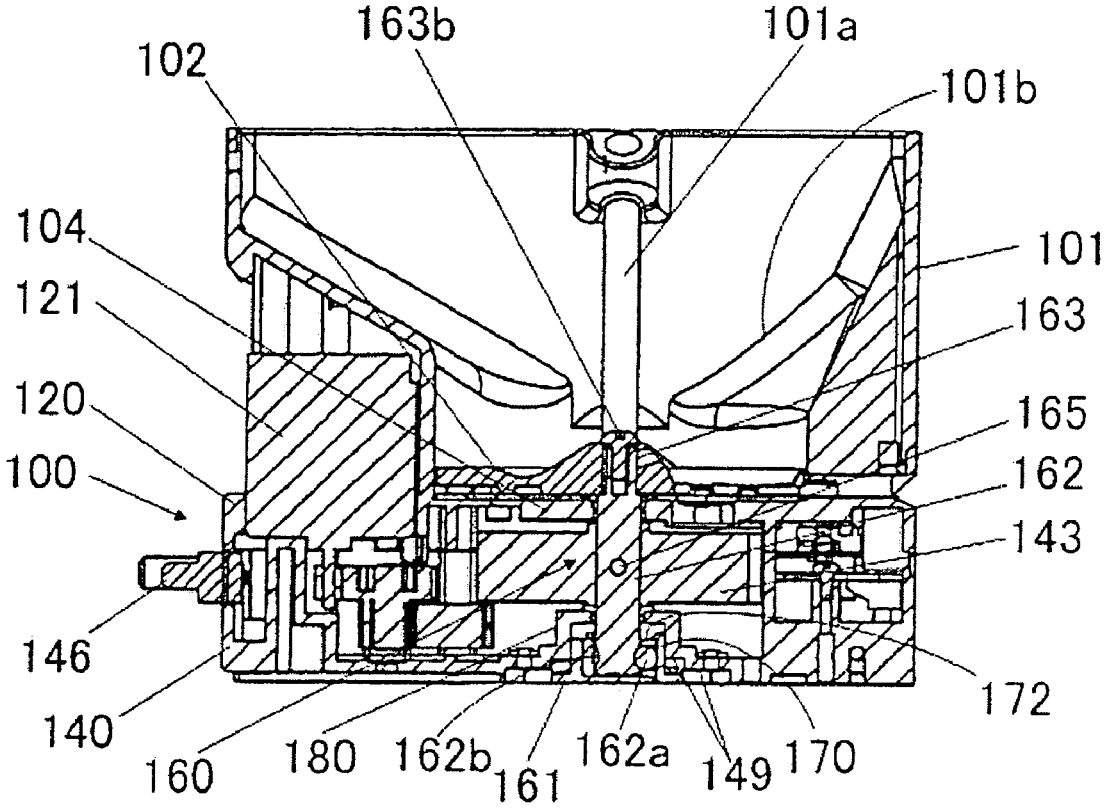
FIG. 3 is a longitudinal sectional view of the apparatus of the embodiment of FIG. 1.

In FIG. 3, reference number 101*a* is a rod which is made from an elastomer. The rod 101*a* holds the coin at through holes 102*a*-102*e*, when the disk 102 rotates. Reference number 101*b* is assigned to a disk attaching section 163. The reference number 163*b* designates a screw for fixing the disk in position. The reference number 165 is a cross bar member, the reference number 170 is a cylinder, the reference number 172 is a lid member and the reference number 180 is a rotating shaft supporting member.

The disk 102 is made from a sintered metal of iron system and it includes through holes 102*a*-102*e* and a projecting section which is unified. Through holes 102*a*-102*e* are used to store the coins and are located at the surface of the disk 102 and separate the coins one by one. The dispensing section 102*f* is a projection for guiding the coins to the through holes 102*a*-102*e* and is located at the center of the disk. The reference number 102*g* is a projection to agitate coins. The reference number 102*h* designates coin pushing sections which are located at the lower edges of through holes 102*a*-102*e*.

A disk attaching base 120 makes up a base stand 103 which is rectangular and is made from ABS resin. The disk base 104, an opening 105 for a motor 121 and attaching holes 106*a*-106*d* for a hopper (not shown in FIG. 1) are located at the upper surface of the base stand 103. Contacting pieces 107*a*-107*f* extend downwards, and are located at the lower edges of the long sides of base stand 103.

A dispensing roller 108 is provided for dispensing coins. An opening 108*a* is provided for the dispensing roller. Coin stoppers 110*a*, 110*b* guide the coins which are moved by disk 102 towards dispensing roller 108 which is adjacent to dispensing roller 108 and opening 109*a*, 109*b*. This is provided for the sensors which detect the dispensed coin, and counts and are located on the upper surface of the base stand 103.

A driving source section 140 is a chassis 141 which is rectangular and is made from ABS resin and has a size generally of the same as disk attaching base 120 and is fitted to disk attaching base 120. The motor 121 is connected to the gear transmitting member 142 which is a power transmitting member. The disk rotating gear 143 is attached to the rotating shaft member 160 and the sensors 144*a*, 144*b* that are located in the chassis 141.

Engaging holes 145*a*-145*f* are located at chassis 141 and are in contact with contacting pieces 107*a*-107*f*. The connectors 146, the joint sections 147*a*, 147*b* for the outside unit and attaching hole 148 of rotating shaftmember 160 at the attaching section of disk rotating gear 143 are located at the short side of the apparatus.

The attaching hole 148 passes through the reverse of chassis 141 and is circular. A plurality of stairs 149A-149D of step section 149 are located around the penetrating section in a circle. In other words, the stairs 149A-149D enclose attaching hole 148 and they are located radially. To provide marks is desirable because they appear to be the same thickness of the coins and are located at the stairs 149A-149D. A pedestal section 161 of rotating shaft member 160 is fitted to one of the stairs 149A-149D.

Figure 2:
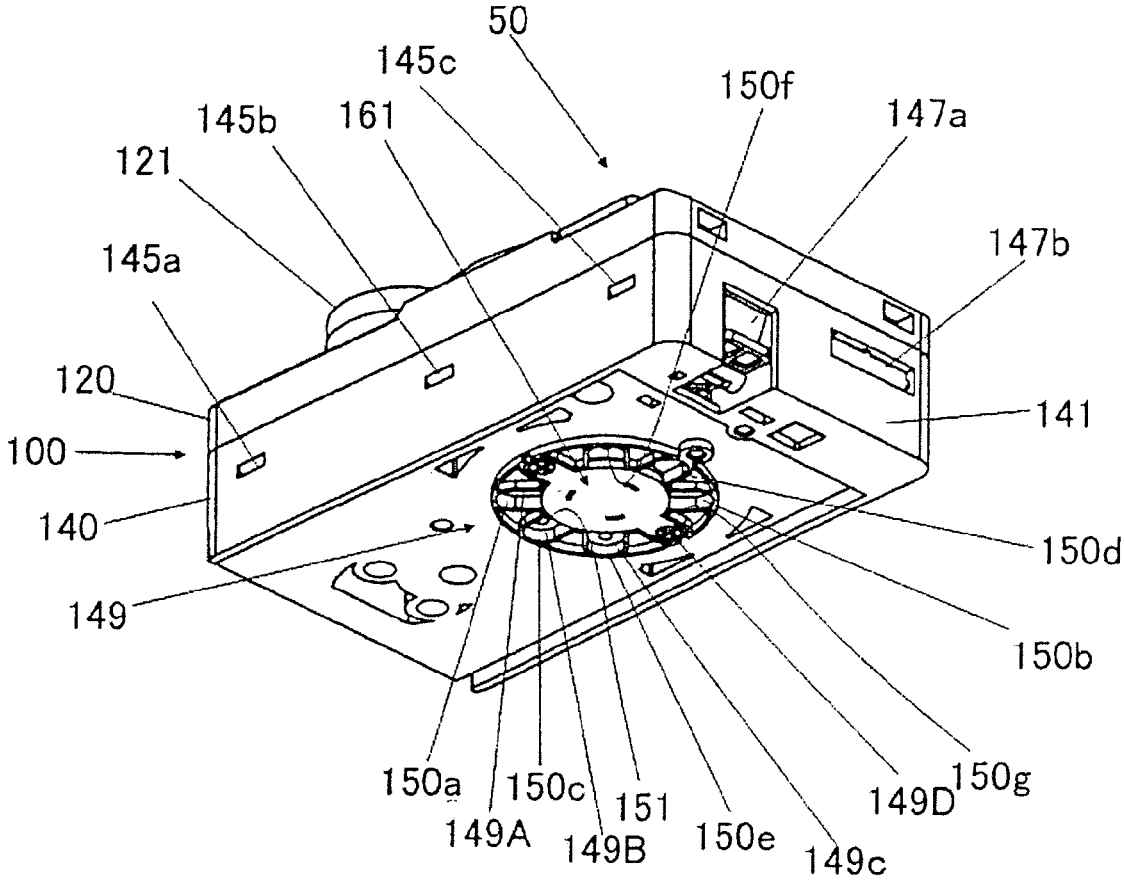
FIG. 2 is a perspective view looking upwards, showing the coin dispensing apparatus of the embodiment of FIG. 1.
Figure 7:
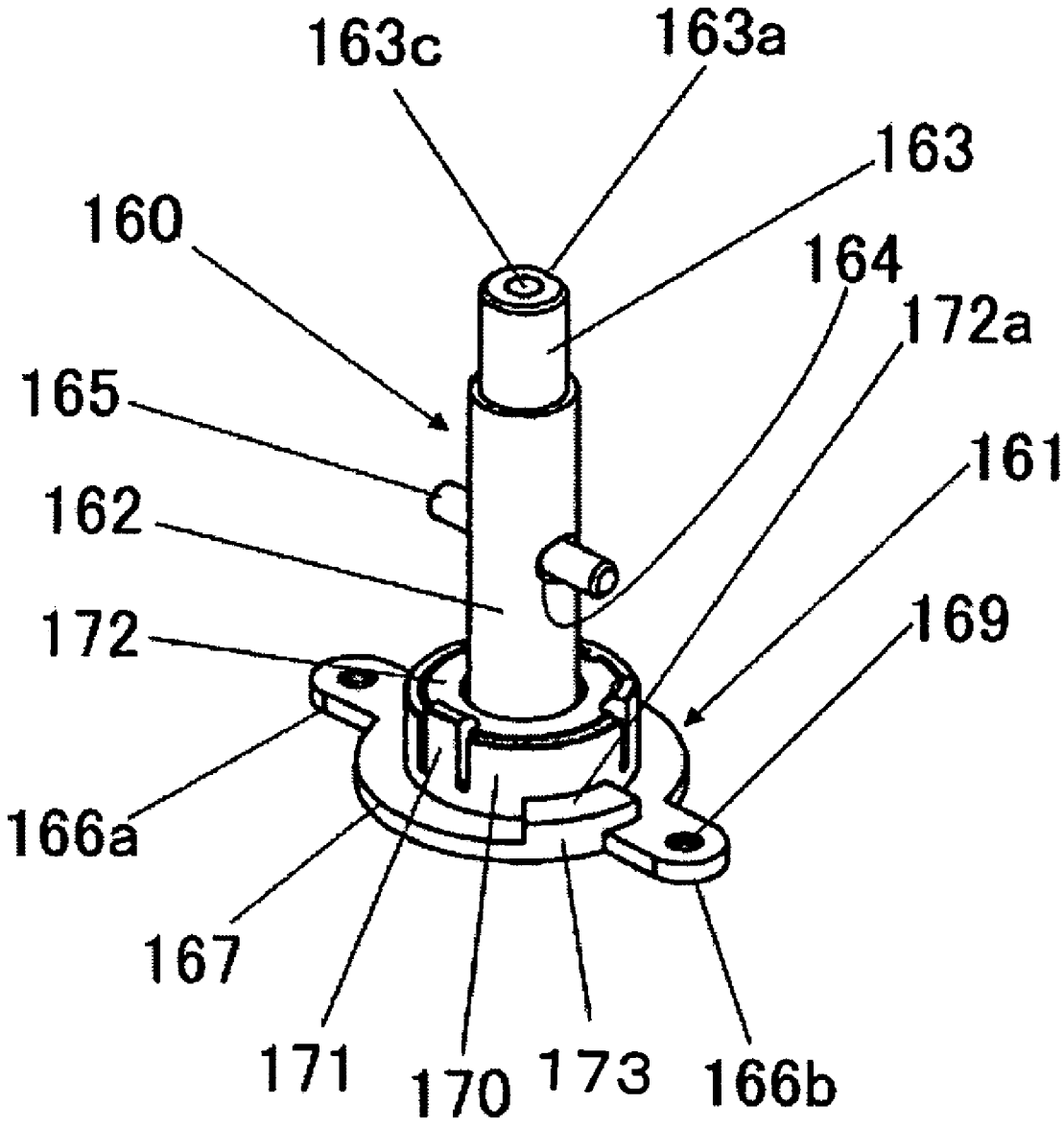
FIG. 7 is a perspective view of the rotating shaft member shown in FIG. 5.
Figure 8:
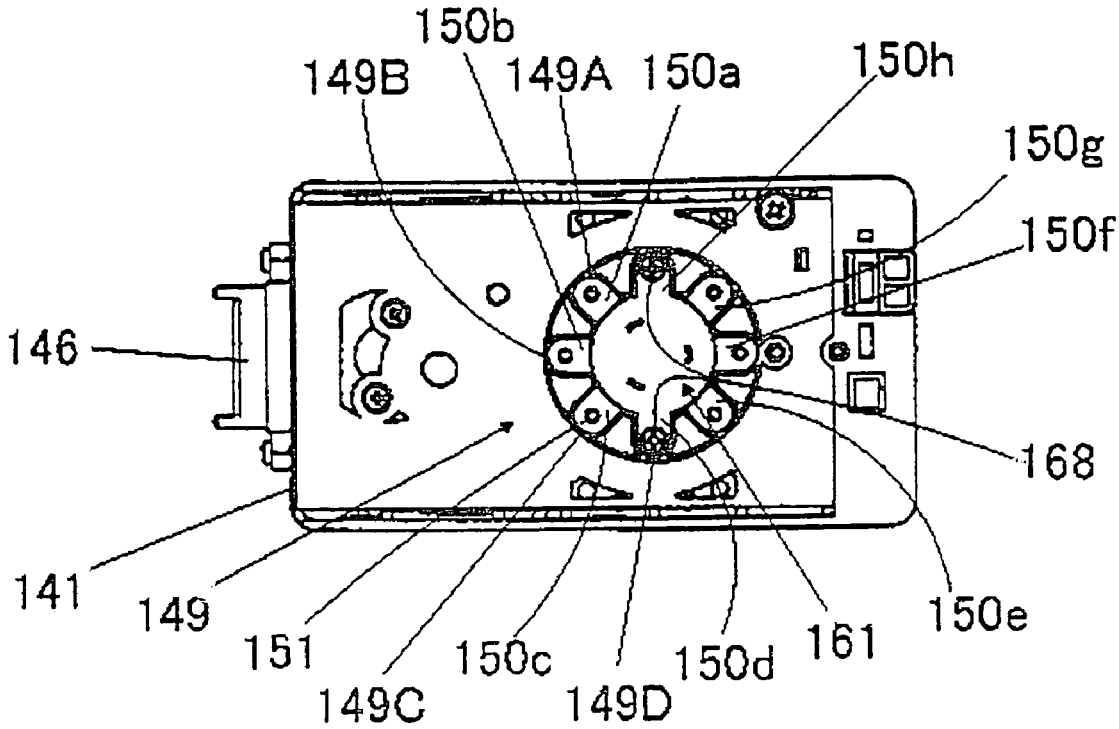
FIG. 8 is a bottom view of the step section at FIG. 2 of the embodiment of FIG. 1.

As shown in FIGS. 2 and 7, the step section 149 includes plural grooves 150*a*-150*h* which extend radially and are semi-circular at the end and have bases. The grooves 150*a*-150*h* are located on the straight line which passes through the center symmetrically, and it is made up in a spiral stair case structure 149A, 149B, 149C and 149D.

The grooves 150*a*-150*h* are enclosed by walls which project from the base. Screw holes 151 are located at the bases of the grooves 150*a*-150*h*.

The grooves 150*a*-150*h* define the structure of step section 149. The position of rotating shaft member 160 is adjusted by step section 149 to adapt to the thickness of the coins; for example 2.0 mm, 2.5 mm, 3.0 m and 3.5 mm. The rotating shaft member 160 adjusts the distance between the disk 102 and the disk base 104. The disk 102 is changed to the desired height by the plural step sections 149*a*-149D. The depths of grooves 149*a*-149D are deep step by step corresponding to the four thickness of the coins. In other words, grooves on a diagonal line are located at the same distance which is between disk base 104 and the base of the groove. Therefore when the rotating shaft member 160 is attached at one step section of step sections 149A-149D, the height position of disk 102 is adapted to a predetermined thickness.

Also, the step section 149 is not limited to four kinds of coins. The step section 149 can be increased or decreased. Furthermore, the stairs 149A-149D of section 149 can be structured as a spiral stair case.

Figure 4:
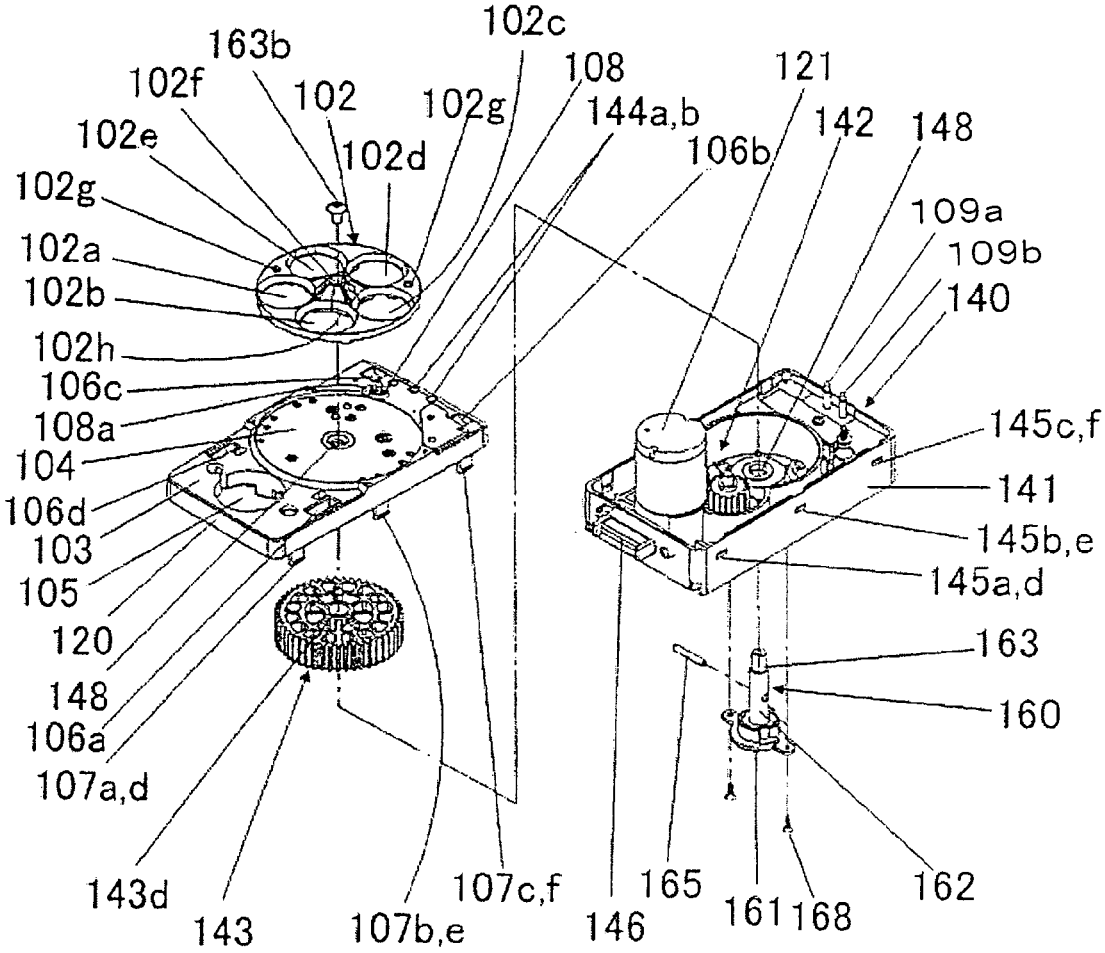
FIG. 4 is an exploded perspective view of the apparatus of the embodiment of FIG. 1.
Figure 5:
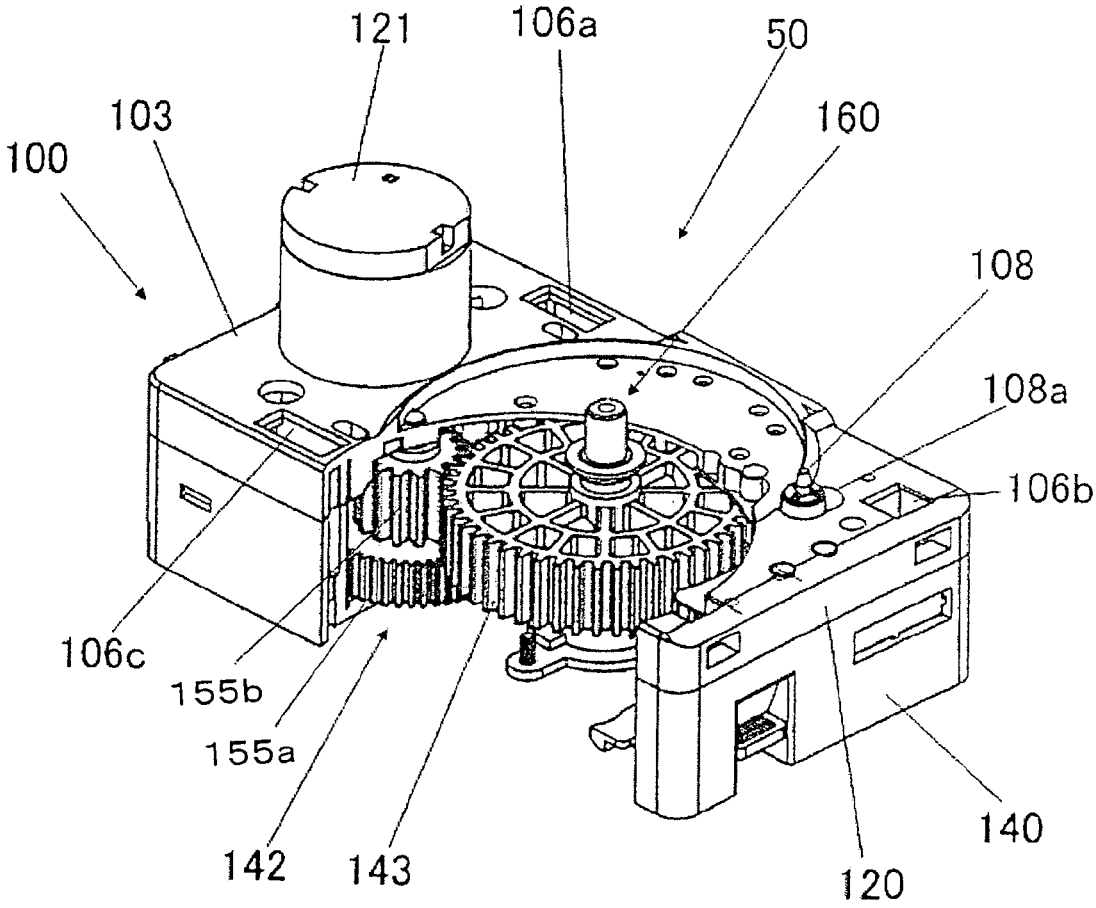
FIG. 5 is an explanatory view of the embodiment of FIG. 1.

Coin dispensing apparatus 50 for the coins is explained below. The rotating shaft member 160 is located below driving source 140 as shown in FIG. 4.

The rotating shaft member 160 includes pedestal section 161 which is made from polyacetal and rotating section 162 which is made from stainless steel as shown in FIG. 7 too. The rotating section 162 includes disk attaching section 163 and penetrating hole 164. The disk attaching section 163 is located at the top of rotating section 162 and the diameter is smaller than the rotating section 162 and is notched at a section. The penetrating hole 164 crosses to the rotating axis of rotating section 162 at a right angle. The cross bar member 165 is inserted into penetrating hole 164 and is detachable.

The Pedestal section 161 includes projecting pieces 166*a*, 166*b* and circle section 167 which connects between the bases of projecting pieces 166*a*, 166*b*. The bottom of projecting pieces 166*a*, 166*b* is flat and is fitted into step section 149 of chassis 141.

The projecting pieces 166*a*, 166*b* are located at a point of symmetry to the center of rotating section 162 and extend to the diameter direction, and the ends are semi-circle like in shape. Also, projecting pieces 166*a*, 166*b* can be established as only one.

Screw holes 169 for screws 168 are located at each of the projecting pieces 166*a*, 166*b*. The screws 168 are screwed into one of screw holes 151 at grooves 150*a*-150*h*. Therefore, pedestal section 161 is fixed at the step section 149 of chassis 141. The pedestal section 161 is not moved upwards, despite the received pushing force from rotating shaft member 160 which is moved by disk 102.

Un-rotating surface 163*a* is notched at a section of disk attaching section 163 and screw hole 163*c* are located at disk attaching section 163. Un-rotating surface 163*a* is fitted to a section of disk 102, and screw 163*b* is screwed into the screw hole 163*c*. As a result, disk 102 is fixed at rotating shaft member 160.

As shown in FIGS. 3 and 7, the pedestal section 161 includes a cylinder section 170 where the cylinder section 170 is smaller than the circular section 167 and stands upwards and is unified. Metal balls 162*a* are enclosed in the cylinder section 170. Three stopping members 171 are located at cylinder section 170 and have elasticity and extend upwards from circular section 167. A lid member 172 is located around rotating section 162 and is hooked by stopping members 171 and holds the metal balls 162*a* in the cylinder section 170.

The ring groove 162*b* which is fitted at a part of the metal balls 162*a* is located at the base of rotating section 162. Also, the outer surface of the rotating section 162, which is located above the ring groove 162*b* is supported by the supporting member 180. The supporting member 180 includes attaching hole 148 which is located on a co-axial line to the center axis of the attaching hole 148 for the rotating shaft member 160 at driving source 140, and is fixed at the bottom of driving source 140.

Protrusion 173 is located between circular section 167 and projecting pieces 166*a*, 166*b* and has contacting surface 172*a* which has contact with the counter boring section which is located at the circle protruding section (not shown) of attaching hole 148 which is located at the reverse side of driving source section 140. In other words, when protruding pieces 166*a*, 166*b* of pedestal section 161 receive the force, which is towards thrust a direction, from the moving disk 102, the protrusion 173 reinforces with the fixed section of the protruding sections 166*a*, 166*b*.

Also the disk rotating gear 143 is located between the disk attaching base 120 and driving source section 140 as shown in FIG. 4. The disk rotating gear 143 is a gear within gears 142 which is a power transmission member and is geared to transmitting gears 155*a*, 155*b*, and it rotates the disk 102 through the rotating shaft member 160.

Figure 6:
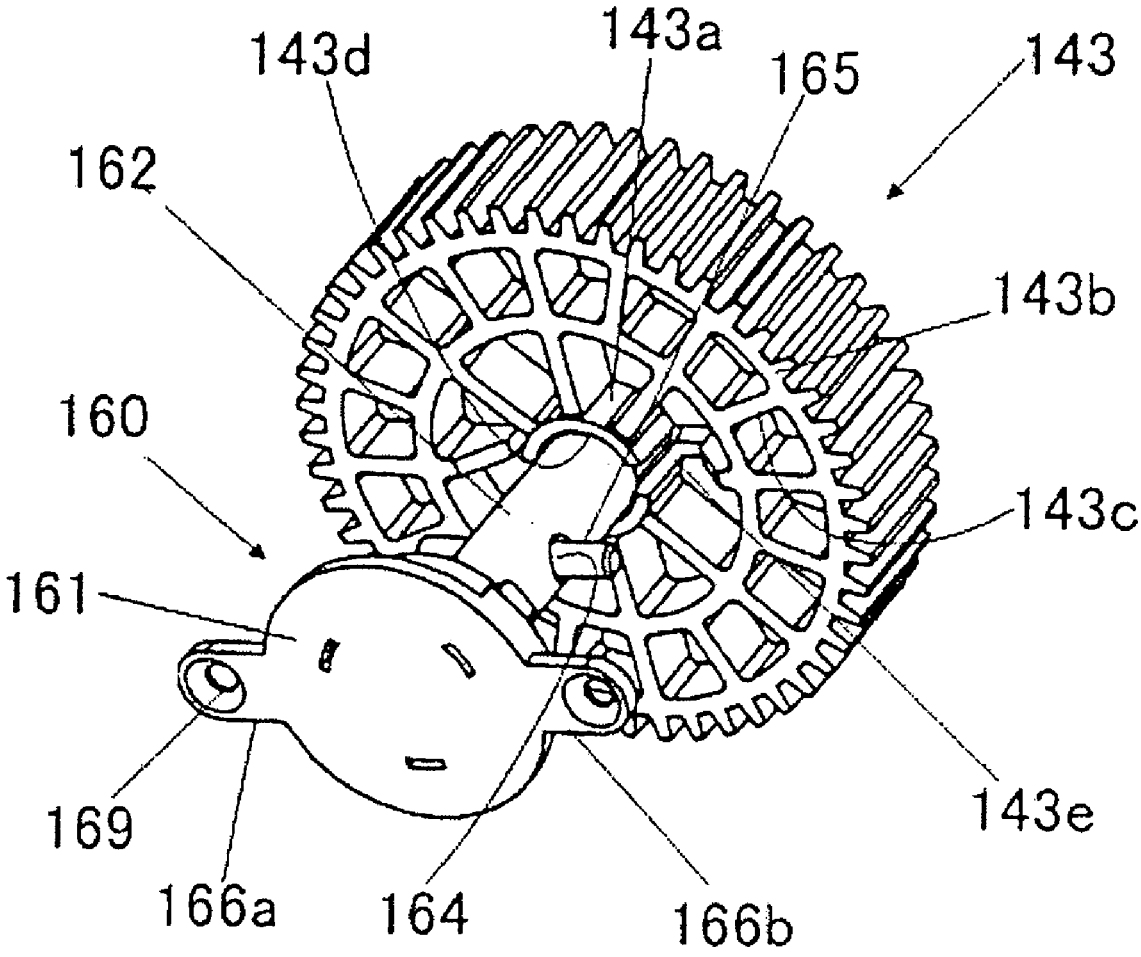
FIG. 6 is a perspective view of the coin rotating gears and the rotating shaft member of the embodiment of FIG. 1.

The disk rotating gear 143 is made from for example polyacetal and includes rib sections 143*c* which are located between boss 143*a* and rim 143*b* as shown in FIG. 6.

An inserting hole 143*d* which received the rotating shaft member 160 and is detachable, is located at the boss section 143*a*. The perpendicularity extending groove 143*e* is located on a crossing line to the axis line of boss section 143*a* and extends along inserting hole 143*d*. The cross bar member 165 at the rotating shaft member 160 is fitted into the groove 143*e* and is detachable.

In above-mentioned coin dispensing apparatus, firstly the rotating shaft member 160 which is detached from the cross bar member 165, is inserted into the attaching hole 148 from the bottom of driving source section 140 as shown in FIG. 4. In this process, the projecting pieces 166*a*, 166*b* of the pedestal section 161 are fitted into the grooves 150*a*-150*h* to adapt to the thickness of the coin at the stairs 149A-149D. Afterwards, the pedestal section 161 is fixed to the grooves 150*a*-150*h* by the screws 168.

Next, the cross bar member 165 is inserted into the rotating shaft member 160 which protrudes from the attaching hole 148 and is unified with the driving source 140. Afterwards, the rotating gear 143 is fitted to the rotating shaft member 160. In this process, the disk rotating gear 143 is geared to the transmitting gear 155*b*, and the cross bar member 165 of the rotating shaft member 160 is inserted into the perpendicular grooves 143*e* of the disk rotating gear 143, and it is established in the driving source section 140.

Also, the disk attaching base 120 is fitted into the driving source section 140 while the positions of the motor 121, rotating shaft member 160 and sensors 109*a*, 109*b* can be seen by the operator. In this process, contacting pieces 107*a*-107*f* of the disk attaching base 120 are fitted into the contacting holes 145*a*-145*f* of the driving source 140. As a result, the disk attaching section 120 is attached to the driving source 140.

Next, the disk attaching section 163 of the rotating shaft member 160 which protrudes on the base 103 of the disk attaching base 103 is fitted to the disk 102. Afterwards, the disk 102 is fixed to the rotating shaft member 160 by the screw 163*b*.

In the rotating shaft member 160, the rotating section 162 and the pedestal section 161 are unified. The rotating shaft member 160 is attached to disk 102 and is attached to the body 100. Therefore the parts of the apparatus decrease and the assembly process is easier.

In this coin dispensing apparatus, the disk 102 can be changed to another disk to adapt to the diameter of coin and the height position of disk 102 can be changed to another position to adapt to the thickness of the coin easily. In other words, when disk 102 is changed, screw 163*b* is off from screw hole 163*c* of the rotating shaft member 160, afterwards the disk 102 is detached. Then another disk 102 which adapts to the difference diameter of the coin is attached at rotating shaft member 160. When the height position of disk 102 is adjusted, in situation where disk 102 is attached to rotating shaft member 160, pedestal section 161 of rotating shaft member 160 is off from the step section 149 of the driving source section 140.

The pedestal section 161 is fitted into one of the grooves 150*a*-150*h* to adapt to the thickness of driving source section 140 of the step section 149. Afterwards, the pedestal section 161 is fixed by the screws 168. Accordingly, the rotating shaft member 160 moves together with the pedestal section 161. When the rotating shaft member 160 is fitted into the grooves 150*a*-150*h*, the rotating shaft member 160 moves to adapt itself in the perpendicular groove 143*e* of the disk rotating gear 143 through the cross bar member 165.

When the rotating shaft member 160 moves up and down, the cross bar member 165 moves in the perpendicular groove 143*e*, however the disk rotating gear 143 is not moved. Therefore the thickness of the apparatus body doesn't increase. A compact construction is provided.

Also, the disk 102 which is adapted to the diameter of the coin is attached at a rotating shaft member 160 which is fixed at step section 149 of the driving source section 140 by the screw 163*b*. The hopper 101 is fitted into the hopper attaching holes 106*a*-106*d* of the coin attaching base 120. The disk 102 is rotated for dispensing the coins which are provided to the hopper 101.

The disk 102 is rotated in the counter clockwise direction, then the coins on the disk base 104 are moved by disk 102. The coins are guided to coin dispensing roller 108 by coin stoppers 110*a*, 110*b*, afterwards the coins are dispensed outside by dispensing roller 108. In this process, the coin is detected by sensors 109*a*, 109*b* and is counted.

When the coins are moved on the disk base 104 by the disk 102, the disk 102 receives an upward force by the coins. Accordingly, the rotating shaft member 160 receives the force.

The rotating shaft member 160 is attached at pedestal section 161. Therefore the rotating shaft member 160 is not moved in the thrust direction of the shaft by the force. Also, the disk 102 is not moved upwards, because the pedestal section 161 of the rotating shaft member 160, is fixed at the apparatus body 100.

The projecting pieces 166*a*, 166*b* of the pedestal section 161 are fitted into the grooves 150*a*-150*h*. Therefore when rotating shaft member 160 rotates, the torque which is received from the disk 102 receives the forces from the side walls to grooves 150*a*-150*h*.

Therefore screw 168 where the pedestal section 161 is attached at the step section 149 doesn't receive the torque based on the rotation of rotating shaft member 160. As a result, the rotating shaft member 160 is fixed at the body 100 solidly. Also, the rotating shaft member doesn't come off from the body 100. Therefore the coins are dispensed every time.

While a specific embodiment of the invention has been shown and described in detail to illustrate the application of the principles of the invention, it will be understood that the invention may be embodied otherwise without departing from such principles.

What is claimed is:

1. A coin dispensing apparatus, the coin dispensing apparatus comprising:

a disk which separates coins one by one;

a body element including a chassis having a defined bottom surface and a disk attaching member having a defined upper surface, said disk attaching member being connected to said chassis;

a base located at said upper surface of said disk attaching member for sliding coins moved by said disk;

a step section located at said bottom surface of said chassis, said step section having different distances to said upper surface of said disk attaching member to adapt said disk to the thickness of the coins, said step section being parallel to said upper surface;

a rotating shaft member having a rotating section and a pedestal section, said step section surrounding said rotating shaft member, said rotating shaft member having a defined longitudinal axis, said rotating section being supported rotatively at a lower end thereof via said pedestal section, said rotating shaft member extending through said upper surface of said disk attaching member, said pedestal section being selectively attached to said step section and being adjustable relative to said step section, said pedestal section engaging said step section;

a screw for fixing said pedestal section to said step section;

a transmitting gear;

a cross bar member detachably connected to said rotating shaft member; and a disk rotating gear for rotating said disk via said transmitting gear, said disk rotating gear defining an inserting hole for receiving said rotating shaft member, said disk rotating gear having an axis of rotation, said disk rotating gear defining longitudinal grooves for receiving said cross bar member, said disk rotating gear being attached to said rotating shaft member via said cross bar member such that said axis of rotation of said disk rotating gear is aligned with said longitudinal axis of said rotating shaft member, whereby said cross bar member is movable within said longitudinal grooves in an upward and downward direction along said longitudinal direction of said rotating shaft member.

2. A coin dispensing apparatus according to claim 1, wherein the step section includes a plurality of steps which are located around an inserting hole, wherein the rotating shaft member is inserted into the inserting hole.

3. A coin dispensing apparatus according to claim 2, wherein the step section is made in the form of a spiral staircase.

4. A coin dispensing apparatus according to claim 1, further comprising a motor for driving said transmitting gear.

5. A coin dispensing apparatus according to claim 2, wherein:

a first space defined by one step and said upper surface of said disk attaching member corresponds to a first coin receiving space defined by said disk and said base; and a second space defined by another step and said upper surface of said disk attaching member corresponds to a second coin receiving space defined by said disk and said base, said first coin receiving space being of a size that is different than a size of said second coin receiving space.

6. A coin dispensing apparatus according to claim 1, wherein said disk attaching element has connecting elements extending from an edge thereof, said chassis defining connecting element receiving holes, each receiving hole receiving one of said connecting elements.

7. A coin dispensing apparatus according to claim 4, wherein said motor is mounted to said chassis, said disk attaching element defining a motor receiving hole, said motor extending through said motor receiving hole.

8. A coin dispensing apparatus according to claim 1, wherein said disk rotating gear is adjacent said base.

9. A coin dispensing apparatus according to claim 1, wherein said disk is connected to said rotating shaft member via a screw connection.

10. A coin dispensing apparatus according to claim 1, further comprising:

a dispensing roller for dispensing coins;

coin stopper elements for guiding coins moved by said disk towards said dispensing roller.

11. A coin dispensing apparatus, the coin dispensing apparatus comprising:

a disk which receives coins to separate coins one by one;

a chassis having a bottom chassis surface;

a disk receiving element including a disk mounting area located on an upper surface thereof for supporting the coins moved by said disk, said disk receiving element being connected to said chassis to form a base structure;

a step section located on said bottom chassis surface, said step section defining a rotating shaft member receiving hole, said step section being parallel to said upper surface, said step section having a plurality of steps, one of said steps being located at a distance from said upper surface of said disk receiving element that is different than a distance between another step and said upper surface of said disk receiving element, each distance corresponding to a thickness of the coins;

a screw;

a rotating shaft member, said rotating shaft member receiving hole receiving said rotating shaft member such that said rotating shaft member extends through said chassis and said upper surface of said disk receiving element, said rotating shaft member being connected to said disk, said rotating shaft member having a defined longitudinal axis, said rotating shaft member having a pedestal section located at a lower end thereof, said pedestal section being selectively attached to one of said steps via said screw such that said disk and said disk receiving area define a coin receiving space and said disk and said pedestal section engages said one of said steps, said pedestal section being selectively attached to another one of said steps via said screw such that said coin receiving space is increased or decreased in size and said pedestal section engages said another of said steps, whereby said rotating shaft member adjusts a position of said disk to said thickness of the coins;

a transmitting gear;

a cross bar member detachably connected to said rotating shaft member; and a disk rotating gear for rotating said disk via said transmitting gear, said disk rotating gear defining an inserting hole for receiving said rotating shaft member, said disk rotating gear defining longitudinal grooves for receiving said cross bar member, said disk rotating gear being attached to said rotating shaft member via said cross bar member such that said disk rotating gear rotates about said longitudinal axis of said rotating shaft member, whereby said cross bar member is movable within said longitudinal grooves in an upward and downward direction along said longitudinal direction of said rotating shaft member.

12. A coin dispensing apparatus according to claim 11, wherein said plurality of steps are located around an inserting hole, wherein the rotating shaft member is inserted into the inserting hole.

13. A coin dispensing apparatus according to claim 12, wherein said plurality of steps are arranged in a spiral manner.

14. A coin dispensing apparatus according to claim 11, further comprising a motor for driving said transmitting gear.

15. A coin dispensing apparatus according to claim 11, wherein said disk receiving element has connecting elements extending from an edge thereof, said chassis defining connecting element receiving holes, each receiving hole receiving one of said connecting elements.

16. A coin dispensing apparatus according to claim 14, wherein said motor is mounted to said chassis, said disk receiving element defining a motor receiving hole, said motor extending through said motor receiving hole.

17. A coin dispensing apparatus according to claim 11, wherein said disk rotating gear is adjacent said base.

18. A coin dispensing apparatus according to claim 11, wherein said disk is connected to said rotating shaft member via a screw connection, said pedestal being attached to each step via a fastener.

19. A coin dispensing apparatus according to claim 11, further comprising:

a dispensing roller for dispensing coins;

coin stopper elements for guiding coins moved by said disk towards said dispensing roller.

20. A coin dispensing apparatus, the coin dispensing apparatus comprising:

a disk for separating coins one by one;

a housing including a disk mounting element and a chassis having a defined bottom chassis surface, said disk mounting element being connected to said chassis, said disk mounting element having a disk receiving base located on an upper surface thereof for sliding the coins moved by said disk;

a step section having a plurality of stepped pieces located at said bottom chassis surface, one of said stepped pieces being located at a first distance from said upper surface of said disk mounting element, another of said stepped pieces being located at a second distance from said upper surface of said disk mounting element, said first distance being different than said second distance, said first distance corresponding to one coin thickness, said second distance corresponding to another coin thickness, said step section being parallel to said upper surface;

a screw;

a rotating shaft member extending through said chassis and said upper surface of said disk receiving element, said rotating shaft member being connected to said disk, said rotating shaft member having a defined longitudinal axis, said rotating shaft member having a pedestal section located at a lower end thereof, said pedestal section having a radially extending step engaging portion, said rotating shaft member moving said disk when said radially extending step engaging portion of said pedestal section is connected to one of said stepped pieces via said screw such that a coin receiving space is defined between said disk and said disk receiving base, said rotating shaft member moving said disk again when said radially extending step engaging portion of said pedestal section is connected to another one of said stepped pieces via said screw such that said coin receiving space increases or decreases in size, whereby said rotating shaft member adjusts said coin receiving space defined between said disk and said disk receiving base;

a cross bar member detachably connected to said rotating shaft member; and a disk rotating gear for rotating said disk, said disk rotating gear defining an inserting hole for receiving said rotating shaft member, said disk rotating gear defining longitudinal grooves for receiving said cross bar member, said disk rotating gear being attached to said rotating shaft member via said cross bar member such that said disk rotating gear rotates about said longitudinal axis of said rotating shaft member, whereby said cross bar member is movable within said longitudinal grooves in an upward and downward direction along said longitudinal direction of said rotating shaft member.

* * * * *